United States Patent [19]

Carter et al.

[11] Patent Number: 4,596,408

[45] Date of Patent: Jun. 24, 1986

[54] REINFORCED HINGE FOR BOOK COVER

[75] Inventors: Leewood C. Carter; Robin P. Neary, both of Warren, N.J.

[73] Assignee: Book Covers Inc., Newark, N.J.

[21] Appl. No.: 534,124

[22] Filed: Sep. 20, 1983

Related U.S. Application Data

[63] Continuation-in-part of Ser. No. 249,089, Mar. 30, 1981, Pat. No. 4,405,156.

[51] Int. Cl.[4] ..... B42D 1/00

[52] U.S. Cl. ..... 281/36; 281/29

[58] Field of Search ..... 281/29, 36, 37; 412/3, 412/4, 5, 17, 26

[56] References Cited

U.S. PATENT DOCUMENTS

| | | | |
|---|---|---|---|
| 316,051 | 4/1885 | Mulqueen | 281/29 |
| 1,365,335 | 1/1921 | Miles | 281/29 |
| 1,913,969 | 6/1933 | Wood | 281/29 X |
| 2,583,403 | 1/1952 | Wiser | 281/29 X |
| 3,145,033 | 8/1964 | Caddoo | 281/29 |
| 3,167,328 | 1/1965 | Dengle et al. | 281/29 |
| 3,244,436 | 4/1966 | McKowen | 281/29 |
| 3,273,913 | 9/1966 | Mullen et al. | 281/29 |
| 3,318,618 | 5/1967 | Mullen et al. | 281/29 |

FOREIGN PATENT DOCUMENTS

| | | | |
|---|---|---|---|
| 1099997 | 2/1961 | Fed. Rep. of Germany . | |
| 964283 | 5/1950 | France | 281/29 |
| 69877 | 1/1946 | Norway . | |
| 345869 | 6/1960 | Switzerland . | |
| 1044481 | 9/1961 | United Kingdom . | |

*Primary Examiner*—Paul A. Bell

*Attorney, Agent, or Firm*—Ezra Sutton

[57] ABSTRACT

A book cover having a reinforced hinge including a reinforcing member secured to the edges of the leafboards of the book cover, a hinge member secured to the outer surface of the reinforcing member and a central lining paper adhered to the inner surface of the reinforcing member, so that the composite structure cooperates to form a reinforced hinge for a book cover.

8 Claims, 6 Drawing Figures

REINFORCED HINGE FOR BOOK COVER

RELATED APPLICATION

This application is a continuation-in-part of application Ser. No. 249,089, filed Mar. 30, 1981, now U.S. Pat. No. 4,405,156.

FIELD OF THE INVENTION

The present invention relates generally to improved book covers and, more particularly, to a book cover including a reinforced hinge.

BACKGROUND OF THE INVENTION

Book covers are typically formed from two spaced-apart leafboards formed of laminated paperboard material, with the spaced-apart leafboards being connected together by a hinge member, as shown, for example, in U.S. Pat. No. 3,145,033. As disclosed in this patent, a tape member connects the two leafboards together and forms the hinge for the book cover. However, it has been found that a hinge member formed in this manner does not have the required strength to resist tearing and ripping as a result of the books being opened and closed continuously, and as a result of books being pulled from their shelves by the hinge member.

There have been previous attempts to strengthen the hinge member of book covers, and one example is found in U.S. Pat. No. 3,138,618. In this book cover, the edges of the hinge material are sandwiched between the layers of each of the front and back leafboards of the book cover, and the hinge is formed between the inner edges of the leafboards and the spine section. However, these hinge sections are relatively thin and also become weakened after use and have a tendency to tear or crack.

Also of interest is U.S. Pat. No. 3,228,709, which includes a cover board extending the entire width of the book cover. Although a central narrow strip reinforces the cover board at its center, hinge areas between the central narrow strip and the leafboard are not reinforced.

Accordingly, it is an object of the present invention to provide a book cover having a reinforced hinge which overcomes the aforesaid problems. Specifically, it is within the contemplation of the present invention to provide an improved reinforced member for a book cover, wherein the reinforced hinge is much stronger and durable than hinge members for book covers used in the past.

It is also an object of the present invention to provide a book cover having a reinforced hinge member which does not increase the thickness of the leafboards at the portion where the hinge member overlaps the leafboards.

SUMMARY OF THE INVENTION

Briefly, in accordance with the principles of the present invention, there is provided a book cover including a reinforced hinge, wherein two spaced-apart leafboards are connected by a reinforcing scrim member, which overlaps edge portions of the leafboards and is glued thereto. The reinforcing scrim member can be formed of any suitable material, such as nylon, cheesecloth, polyester, rayon, olefins, acrylics, acetates or cotton. A paperboard hinge member overlaps and is adhered to the reinforcing member and extends beyond the edges of the reinforcing member to also overlap the leafboards, and the hinge member is directly adhered to the edge portions of the leafboards by glue or the like. This hinge member could also be made from vinyl, or a similar material, which would be suitable for di-electric heat sealing of the cover. This direct adherence of the hinge member to the leafboard provides a better and superior bond, as compared to adhering the hinge member to the reinforcing member and then adhering the reinforcing member to the leafboard.

The scrim member can be in two sections to save material, and also the scrim member may be adhered between the plies of the leafboards.

Next, a paper lining strip or spine member is secured to the inner surface of the reinforcing member and is arranged so that its edges are spaced apart from the edge portions of the leafboards.

In addition, in the preferred embodiments, the edge portions of the leafboards are indented by applying pressure thereto and are indented by an amount at least equal to the thickness of the reinforcing member and the paper hinge member so that the thickness of the leafboards are not increased by the overlapping reinforcing member and hinge member. Alternatively, the plies of the leafboards may be offset to receive the scrim and hinge member.

Advantageously, as a result of the present invention, the reinforcing member, the outer paper hinge member, and the inner lining paper or spine are all glued together and cooperate to form and improved reinforced hinge for the book cover, which has greater strength and durability to resist tearing and/or cracking during continued use. In addition, the fact that the edge portions of the leafboards are intended to receive the reinforcing scrim member and hinge member, the overall thickness of the leafboards is not increased as a result of the improved reinforced hinge of the present invention.

BRIEF DESCRIPTION OF THE DRAWINGS

Further objects, features and advantages of the present invention will become apparent upon the consideration of the following detailed description of a presently preferred embodiment, when taken in conjunction with the accompanying drawings, wherein.

DETAILED DESCRIPTION OF PREFERRED EMBODIMENT OF THE INVENTION

Figure 1:
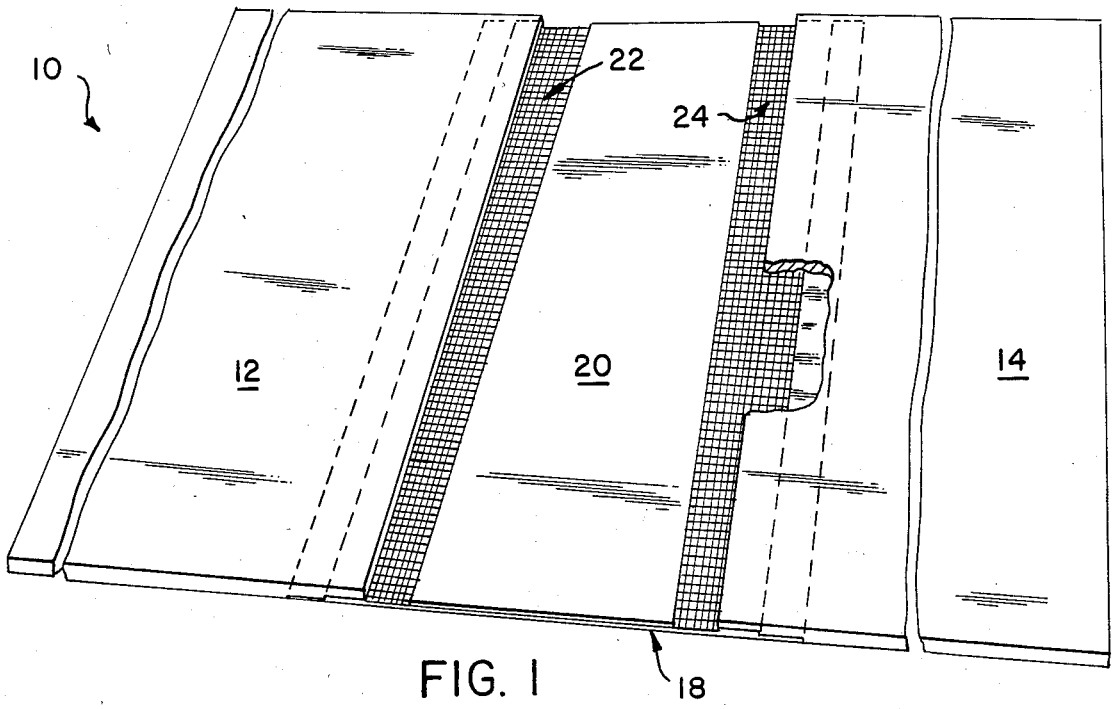
FIG. 1 is a perspective view of a book cover having a reinforced hinge in accordance with the present invention.

Referring to the drawings, there is shown a book cover having a reinforced hinge in accordance with the present invention, generally designated by the reference numeral 10. Leafboards 12, 14 are provided and are formed of paperboard material in the usual manner. In the preferred embodiment, one sheet of paperboard, or multiple plies of paperboard for heavier covers, is started with, and the resulting web is slit down its center and spaced apart to form the two leafboards 12, 14. The leafboards include respective edge portions 12*a*, 14*a* on their outer surfaces, for a purpose to be explained. Also, the leafboards 12, 14 are spaced apart, so that edge portions 12*a*, 14*a* are opposite to each other and are in a parallel relationship.

The book cover 10 also includes reinforcing members 16, such as reinforcing scrim members, formed in two sections 17 and 17', having a space 16*c* therebetween. The reinforcing members 16 can be formed from any suitable reinforcing materials, such as nylon, cheesecloth, polyester, rayon, olefins, acrylics, acetates or cotton. In the preferred embodiment, polyester scrim reinforcing material is preferred, since it provides the best combination of strength and stability. The reinforcing members 16 includes a first edge surface 16*a* on section 17 and a second edge surface 16*b* on section 17', which edge surfaces are intended to be adhered to or secured to edge surfaces 12*b*, 14*b*, respectively, of edge portions 12*a*, 14*a* of leafboards 12, 14. In the preferred embodiment, glue is applied to edge surfaces 16*a*, 16*b* before such surfaces are brought into contact with edge surfaces 12*b*, 14*b* of the leafboards and adhered thereto. Alternatively, precoated reinforcing scrim members 16 may be employed. As will be noted, after reinforcing member 16 is secured to spaced-apart leafboards 12, 14, spaces 12*c*, 14*c* remain on edge portions 12*a*, 14*a* of respective leafboards 12, 14, for a purpose to be explained.

The book cover 10 of the present invention also includes a hinge member 18 formed of paperboard or vinyl, which includes a central surface portion 18*a* and edge surfaces 18*b*, 18*c* formed on the ends of hinge member 18. In the preferred embodiment, glue or suitable adhesive, is applied to surfaces 18*a*, 18*b* and 18*c*. Then, central surface portion 18*a*, with the glue thereon, is brought into contact with the outer surfaces of sections 17 and 17' of reinforcing members 16 and is adhered thereto. As will be noted, the width of paperboard hinge member 18 is slightly wider than the width of reinforcing members 16. When the members 16, 18 are brought into contact, they are arranged such that the edge surface 18*b* extends beyond one edge of reinforcing section 17 approximately ¼ inch, and the other edge surface 18*c* extends beyond the other edge of reinforcing section 17' approximately ¼ inch. In this manner, edge surface 18*b*, with the glue thereon, may be adhered to the surface portion 12*c* of leafboard 12 and edge surface 18*c*, with the glue thereon, may be adhered to surface portion 14*c* of leafboard 14.

As a result, direct adherence is obtained between the edges 18*b*, 18*c* of the hinge member 18 and surfaces 12*c*, 14*c* of leafboards 12, 14. This direct adherence of the hinge member 18 of the leafboards 12, 14 provides a better and superior bond, as compared to having the reinforcing members 16 and the hinge member 18 being of the same length, and then adhering the hinge member 18 to the reinforcing members 16, and then adhering the reinforcing members 16 to the respective leafboards 12, 14, so that there is no direct contact between hinge member 18 and the leafboards. This latter arrangement, wherein the reinforcing members 16 and the hinge member 18 are of the same width, is intended to be included within the scope of the present invention, although in the preferred embodiment, hinge member 18 is wider than reinforcing members 16 and space 16*c* to provide the direct adherence between the edges 18*b*, 18*c* of the hinge member 18 and the respective leafboards 12, 14.

The improved book cover 10 of the present invention also includes a strip of lining paper 20 formed of paperboard material and havng suitable adhesive or glue on surface 20*a* thereof. The strip of lining paper 20 overlaps and is adhered to reinforcing members 16, and through space 16*c* is adhered directly to hinge member 18. The longitudinal edges 20*b*, 20*c* are spaced from edge portions 12*a*, 14*a* of leafboards 12, 14. As a result, reinforced hinge sections 22, 24 are formed by such spaces on either side of central reinforced hinge section 26.

Accordingly, as will be understood, reinforcing members 16 reinforce all of the hinge sections 22, 24 and 26, and its edges 16*a*, 16*b* are directly adhered to the respective leafboards 12, 14, so that members 16 are securely integrated and bound to the book cover structure 10 of the present invention. The outer paperboard hinge member 18 covers the irregular surface of reinforcing members 16 and provides additional strength and durability thereto, and is also directly adhered at its edges 18*b*, 18*c* to the respective leafboards 12, 14. In this manner, reinforcing members 16 of the present invention are securely integrated into the composite structure of the improved book cover 10 of the present invention, without weakening the manner in which any of the outer components, such as the leafboards 12, 14 and outer paperboard hinge member 18 are adhered together.

It is also noted that the improved reinforced hinge of the present invention can be used in either a round-back type book cover, in which the hinge is not attached to the book cover, or in a tight-back type book cover, in which the hinge is glued to the book cover.

In the preferred embodiment, edge portion 12*a* of leafboard 12 and edge portion 14*a* of leafboard 14 are each indented an amount at least equal to the thickness of the overlapping hinge member 18, so that the thickness of the respective leafboards 12, 14 are not increased by the overlapping of members 16, 18. In the preferred embodiment, the reinforcing member 16 has a thickness of approximately six points and the paperboard hinge member 18 has a thickness of approximately 10 points. Therefore, edge portions 12*a*, 14*a* would be indented approximately 16 points, plus a certain amount for layers of glue, in order to accommodate these thicknesses. Leafboards 12, 14 may be indented in any suitable manner, such as by applying pressure to the paperboard along the edges thereof by suitable dies or the like.

It should also be understood that the above-described method of forming the book cover 10 of the present invention does not have to be performed in the exact sequence described above. For example, lining paper strip 20 may be adhered to reinforcing member 16. In addition, reinforcing members 16, hinge member 18 and lining paper strip 20 may be adhered together before this assembly is adhered to the respective leafboards 12, 14.

In view of the foregoing, it will be appreciated that as a result of the present invention, the reinforcing member 16, the outer paperboard hinge member 18, and the inner lining paper 20 are all glued together and cooperate to form an improved reinforced hinge for a book cover having sections 22, 24, and 26, which have greater strength and durability to resist tearing and/or cracking during continued use.

Figure 3:
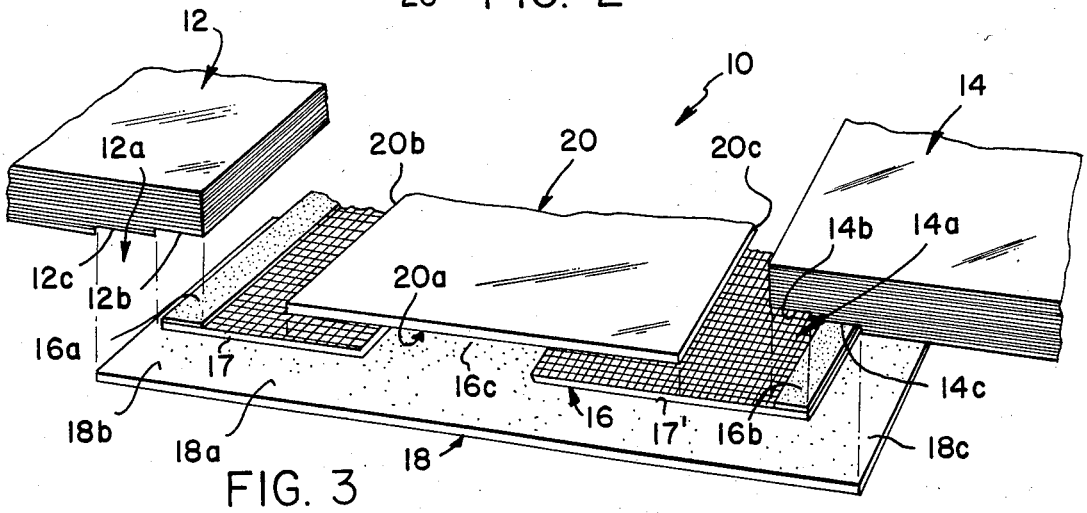
FIG. 3 is an expanded view of a book cover having a reinforced hinge in accordance with the present invention.
Figure 4:
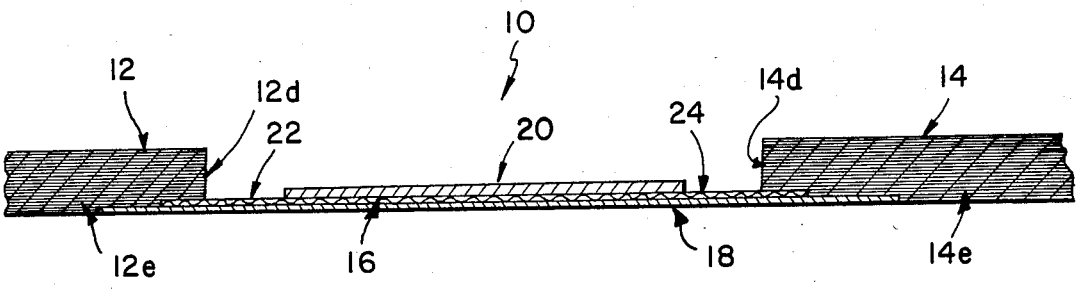
FIG. 4 is a cross-sectional view of a book cover and reinforced hinge formed according to another embodiment of the invention.

Referring to FIG. 4, there is shown an alternative form of the present invention in which the leafboards are not indented, but instead have offset edges. As will be noted, leafboard 12 includes an upper section or plurality of plies 12*d* and a lower section of plies 12*e*. Similarly, leafboard 14 includes an upper section or plurality of plies 14*d* and a lower section of plies 14*e*. The plies 12*e* are not as long as the plies 12*d* and are offset therefrom, as shown in FIG. 4. This is also true of plies 14*e* being shorter than the plies 14*d*, and are offset with respect to each other. Plies 12*e* and 14*e* have been offset to receive reinforcing member 16 and overlapping hinge member 18, so that the thicknesses of the respective leafboards 12, 14 are not increased by the overlapping of members 16, 18 on the leafboards. This construction may be utilized instead of indenting the edge portions of the leafboards as explained above with respect to FIG. 3. It should be noted that the offset plies 12*e*, 14*e* may be formed in any suitable manner to form the space for receiving reinforcing member 16 and hinge member 18. In addition, in this embodiment, the reinforcing member can be in two sections, as shown in FIG. 3.

Figure 2:
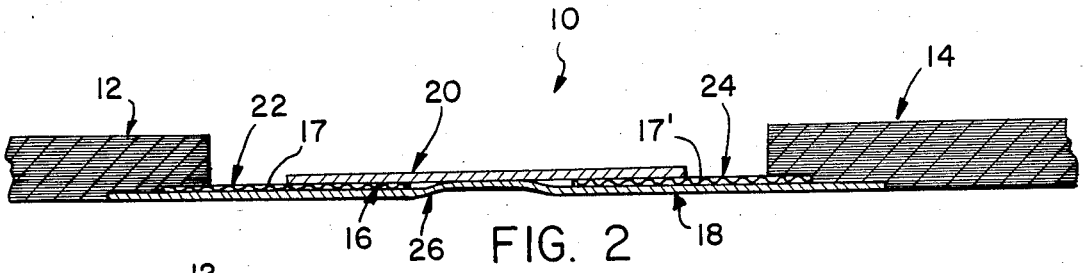
FIG. 2 is a cross-sectional view of a book cover and reinforced hinge formed in accordance with the present invention.
Figure 5:
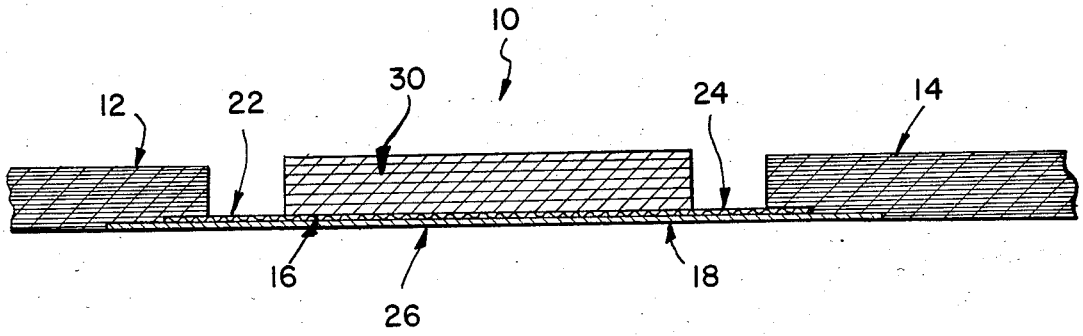
FIG. 5 is a cross-sectional view of a book cover and reinforced hinge formed according to another embodiment of the invention.

Referring now to FIG. 5, there is shown an alternative embodiment of the present invention which incorporates a spine member 30 in place of lining paper 20. The spine member is formed of paperboard material and has suitable adhesive or glue thereon for adhering spine member 30 to reinforcing member 16. As shown, the longitudinal edges of spine member 30 are spaced from the edge portions 12*a*, 14*a* of leafboards 12, 14. As a result, reinforced hinge sections 22, 24 are formed by such spaces on either side of central reinforced hinge section 26. In this embodiment, although reinforcing member 16 has been shown as a single member, it should also be understood that reinforcing member 16 can be formed in two sections as described above with respect to FIGS. 1 to 3.

Figure 6:
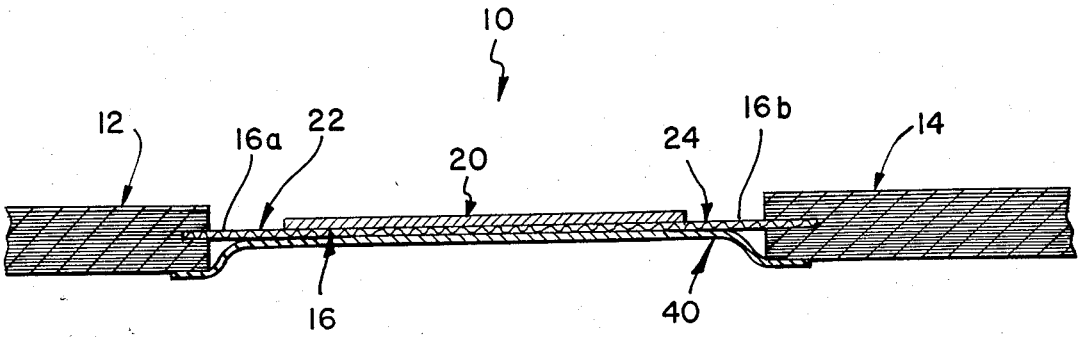
FIG. 6 is a cross-sectional view of a book cover and reinforced hinge formed according to another embodiment of the invention.

In addition, spine member 30 may be used in place of lining paper 20 in the embodiments of FIGS. 3, 4, and 6.

Referring to FIG. 6, there is shown a still further alternative embodiment of the present invention. In this embodiment, the edge portions 16*a*, 16*b* of reinforcing member 16 are sandwiched between the plies of leafboards 12, 14, without increasing the thickness of the leafboards. In addition, the hinge member 40 is glued to the outer surface of reinforcing member 16 and to the edge portions 12*a*, 14*a* of the leafboards. Alternatively, hinge member 40 can also be sandwiched between the plies of the leafboards along with reinforcing member 16. Still further, reinforcing member 16 can be formed in two sections, as shown in FIG. 3. Further, in this embodiment, spine member 30 may be used in place of lining paper 20.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A book cover having a reinforced hinge comprising:

first and second leafboards having respective first and second edge portions in opposed, spaced and parallel relationship;

a flexible reinforcing member including two spaced apart sections, each of said reinforcing sections including an edge overlapping and secured to said first and second edge portions, respectively;

a stiff hinge member overlapping and adhered to the outer surface of said reinforcing sections for maintaining the spacing of said first and second leafboards;

an inner layer of material overlapping and adhered to the inner surface of said reinforcing sections, the longitudinal edges of said inner layer being spaced from said first and second edge portions of said leafboards, respectively; and said reinforcing sections, said hinge member and said inner layer, all being adhered together and cooperating to form a reinforced hinge for said book cover.

2. A book cover in accordance with claim 1, wherein said first and second edge portions of said leafboards are indented an amount at least equal to the thickness of said overlapping reinforcing sections and said overlapping hinge member.

3. A book cover in accordance with claim 1, wherein said first and second edge portions of said leafboards each have first and second plies offset with respect to each other to receive said reinforcing sections and said hinge member without increasing the thickness of said first and second leafboards.

4. A book cover in accordance with claim 1, wherein the first and second edges of said hinge member extend beyond the edges of said reinforcing member to overlap and directly adhere to said first and second edge portions of said leafboards, respectively.

5. A book cover in accordance with claim 1, wherein said inner layer is a spine member of paperboard material.

6. A book cover in accordance with claim 1, wherein said reinforcing member is formed of nylon.

7. A book cover in accordance with claim 1, wherein said reinforcing member is formed of cheesecloth.

8. A book cover in accordance with claim 1, wherein said reinforcing member is formed of polyester.

* * * * *